US009831548B2

(12) United States Patent
Timofeev et al.

(10) Patent No.: US 9,831,548 B2
(45) Date of Patent: Nov. 28, 2017

(54) DUAL-BEAM SECTOR ANTENNA AND ARRAY

(75) Inventors: Igor Timofeev, Dallas, TX (US); Martin Zimmerman, Chicago, IL (US); Huy Cao, Garland, TX (US); Yanping Hua, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 1021 days.

(21) Appl. No.: 13/127,592

(22) PCT Filed: Nov. 12, 2009

(86) PCT No.: PCT/US2009/006061

§ 371 (c)(1),
(2), (4) Date: May 4, 2011

(87) PCT Pub. No.: WO2010/059186

PCT Pub. Date: May 27, 2010

(65) Prior Publication Data

US 2011/0205119 A1 Aug. 25, 2011

Related U.S. Application Data

(60) Provisional application No. 61/199,840, filed on Nov. 20, 2008.

(51) Int. Cl.
*H01Q 3/00* (2006.01)
*H01Q 3/26* (2006.01)
(Continued)

(52) U.S. Cl.
CPC ..... *H01Q 3/26* (2013.01); *H01Q 1/246* (2013.01); *H01Q 3/30* (2013.01); *H01Q 25/002* (2013.01);
(Continued)

(58) Field of Classification Search
CPC ..... H01Q 3/26; H01Q 3/263; H01Q 3/267; H01Q 3/28; H01Q 3/30; H01Q 3/40; H01Q 25/002; H01Q 25/02
(Continued)

(56) References Cited

U.S. PATENT DOCUMENTS 3,255,450 A * 6/1966 Butler ..... H01Q 3/40 342/373
4,584,581 A 4/1986 Teshirogi
(Continued)

FOREIGN PATENT DOCUMENTS

CA 2540218 9/2007
CA 2645720 9/2007
(Continued)

OTHER PUBLICATIONS

"Design of a dual-beam antenna used for base station of cellular mobile radios"; Y. Ebine, M. Ito; Electronics and Communications in Japan (Part I: Communications); vol. 80, Issue 12, pp. 38-46, Dec. 1997.*

(Continued)

*Primary Examiner* — Chuong P Nguyen
(74) *Attorney, Agent, or Firm* — Myers Bigel, P.A.

(57) ABSTRACT

A low sidelobe beam forming method and dual-beam antenna schematic are disclosed, which may preferably be used for 3-sector and 6-sector cellular communication system. Complete antenna combines 2-, 3- or -4 columns dual-beam sub-arrays (modules) with improved beam-forming network (BFN). The modules may be used as part of an array, or as an independent 2-beam antenna. By integrating different types of modules to form a complete array, the present invention provides an improved dual-beam antenna with improved azimuth sidelobe suppression in a wide frequency band of operation, with improved coverage of a
(Continued)

desired cellular sector and with less interference being created with other cells. Advantageously, a better cell efficiency is realized with up to 95% of the radiated power being directed in a desired cellular sector.

20 Claims, 10 Drawing Sheets

(51) Int. Cl.

| | |
|---|---|
| ***H01Q 3/30*** | (2006.01) |
| ***H01Q 25/00*** | (2006.01) |
| ***H01Q 1/24*** | (2006.01) |
| *H01Q 25/02* | (2006.01) |
| *H01Q 3/28* | (2006.01) |
| *H01Q 3/40* | (2006.01) |
| *H01Q 21/06* | (2006.01) |
| *H01Q 21/24* | (2006.01) |

(52) U.S. Cl.
CPC ..... *H01Q 3/28* (2013.01); *H01Q 3/40* (2013.01); *H01Q 21/061* (2013.01); *H01Q 21/24* (2013.01); *H01Q 25/00* (2013.01); *H01Q 25/02* (2013.01)

(58) Field of Classification Search
USPC ..... 342/373, 374, 380, 383
See application file for complete search history.

(56) References Cited

U.S. PATENT DOCUMENTS

| | | | | |
|---|---|---|---|---|
| 4,638,317 | A | 1/1987 | Evans | |
| 5,115,248 | A * | 5/1992 | Roederer | H01Q 3/2658 342/368 |
| 5,177,491 | A | 1/1993 | Lopez | |
| 5,581,260 | A | 12/1996 | Newman | |
| 5,666,655 | A | 9/1997 | Ishikawa et al. | |
| 5,686,926 | A * | 11/1997 | Kijima et al. | 342/373 |
| 5,907,816 | A | 5/1999 | Newman et al. | |
| 6,081,233 | A | 6/2000 | Johannisson | |
| 6,094,165 | A * | 7/2000 | Smith | 342/373 |
| 6,127,972 | A * | 10/2000 | Avidor et al. | 342/373 |
| 6,167,036 | A | 12/2000 | Beven | |
| 6,198,434 | B1 | 3/2001 | Martek et al. | |
| 6,311,075 | B1 | 10/2001 | Bevan et al. | |
| 6,317,100 | B1 * | 11/2001 | Elson | H01Q 21/22 343/833 |
| 6,463,301 | B1 | 10/2002 | Bevan et al. | |
| 6,463,303 | B1 | 10/2002 | Zhao | |
| 6,480,524 | B1 | 11/2002 | Smith et al. | |
| 6,608,591 | B2 * | 8/2003 | Wastberg | H01Q 1/246 342/373 |
| 6,771,218 | B1 * | 8/2004 | Lalezari | G01S 13/48 342/373 |
| 7,038,621 | B2 | 5/2006 | Gabriel et al. | |
| 7,098,848 | B2 * | 8/2006 | Ksienski | H01Q 25/00 342/372 |
| 7,327,323 | B2 | 2/2008 | Jackson et al. | |
| 7,388,552 | B2 | 6/2008 | Mori | |
| 7,400,606 | B2 | 7/2008 | Padovani et al. | |
| 7,792,547 | B1 | 9/2010 | Smith et al. | |
| 7,817,096 | B2 * | 10/2010 | Linehan | 343/757 |
| 8,269,687 | B2 * | 9/2012 | Lindmark | H01Q 1/246 343/810 |
| 9,077,083 | B1 * | 7/2015 | Freeman | H01Q 21/24 |
| 2002/0021246 | A1 * | 2/2002 | Martek et al. | 342/373 |
| 2004/0038714 | A1 * | 2/2004 | Rhodes et al. | 455/562.1 |
| 2004/0235528 | A1 | 11/2004 | Korisch | |
| 2006/0164284 | A1 * | 7/2006 | Pauplis | G01S 7/2813 342/16 |
| 2009/0096702 | A1 * | 4/2009 | Vassilakis et al. | 343/836 |
| 2012/0319900 | A1 * | 12/2012 | Johansson | H01Q 1/246 342/368 |
| 2015/0084832 | A1 * | 3/2015 | Ai | H01Q 1/246 343/893 |
| 2015/0333884 | A1 * | 11/2015 | Athley | H04L 5/0048 375/295 |

FOREIGN PATENT DOCUMENTS

| | | | |
|---|---|---|---|
| CN | 1540903 | A | 10/2004 |
| CN | 1921341 | | 2/2007 |
| CN | 101051860 | | 10/2007 |
| CN | 1921341 | A | 7/2009 |
| CN | 101051860 | B | 8/2010 |
| IN | 240893 | A1 | 6/2010 |
| JP | 2006066993 | | 3/2006 |
| WO | 0115477 | A1 | 3/2001 |
| WO | 0249150 | A2 | 6/2002 |
| WO | 02102106 | A1 | 12/2002 |
| WO | 03045094 | A1 | 5/2003 |
| WO | 2004032393 | A2 | 4/2004 |
| WO | 2005053182 | A1 | 6/2005 |
| WO | PCT/SE05/000643 | | 11/2005 |
| WO | 2006/004463 | A1 | 1/2006 |
| WO | 2007/106989 | A1 | 9/2007 |
| WO | 2010/059186 | A2 | 5/2010 |

OTHER PUBLICATIONS

TENXC Wireless; Higher Capacity Through Multiple Beams Using Asymmetric Azimuth Arrays; Presentation given at CDG Technology Forum; Apr. 20, 2006; pp. 1-28.

Osseiran et al.; System Performance of Transmit Diversity Methods and a Two Fixed-Beam System in WCDMA; Wireless Personal Communications 31-33-50; 2004.

Mobile Dev Design; Wireless Solution Boosts Network Capacity; Mar. 1, 2006.

Saunders; Antennas and Propagation for Wireless Communication Systems; Wiley, 1999, New York.

Wacker, et al.; The Impact of the Base Station Sectorisation on WCDMA Radio Network Performance; Proceeding of the IEEE Vehicular Communications Technology Conference, VTC 1999, Houston, Texas, May 1999, pp. 2611-2615.

Hall, et al.; Review of Radio Frequency Beamforming Techniques for Scanned and Multiple Beam Antennas; Microwaves, Antennas and Propagation IEE Proceedings H (vol. 137, Iss. 5) Oct. 1990; pp. 293-303.

Allen, et al.; A Theoretical Limitation on the Formation of Lossless Multiple Beams in Linear Arrays; Antennas and Propagation, IRE Transactions (vol. 9, Iss. 4) Jul. 1961; pp. 350-352.

Taylor, et al.; Design of Line-Source Antennas for Narrow Beamwidth and Low Side Lobes; Antennas and Propagation, (vol. 3 Iss. 1) Jan. 1955; pp. 16-28.

Van Veen et al.; Beamforming: A Versatile Approach to Spatial Filtering; IEEE ASSP Magazine Apr. 1988; pp. 4-24.

Johnson; Antenna Engineering Handbook, 3rd Ed. McGraw Hill; 1993.

Dolph; A Current Distribution for Broadside Arrays Which Optimizes the Relationship Between Beam Width and Side-Lobe Level; Proceedings of the IRE (vol. 34, Iss. 6 ) Jun. 1946.

Elliott; Design of line source antennas for narrow beamwidth and asymmetric low sidelobes; IEEE Trans. AP, Jan. 1975, pp. 100-107.

Osseiran et al.; Downlink Capacity Comparison between Different Smart Antenna Concepts in a Mixed Service MCDMA System; pp. 1-5.

Metawave Communications Corporation; Spotlight 2000's Sitesculptor Software; Redmond, WA 2000.

Metawave Communications Corporation; A Spotlight 2000 Case Study; SpotLight 2000 Six-Sector Configuration Delivers 74% Capacity Increase for CDMA Cell Site; Redmond, WA 2000.

Metawave Communications Corporation; Spotlight 2210 CDMA System for the Nortel Networks CDMA Metro Cell; Redmond, WA 2001.

(56) References Cited

OTHER PUBLICATIONS

Metawave Communications Corporation; Spotlight 2210 CDMA System for the Motorola SC 4812 Cell Site; Redmond, WA 2001.
Gordon; Smart Cell Site Optimization; CDMA Solutions Seminar Series (Seminar Two) Metawave Communications Corporation; Redmond WA pp. 1-16.
Osseiran; et al.; System Performance of Multi-Beam Antennas for HS-DSCH WCDMA System; pp. 1-5.
Ji-Hae Yea; Make six-sector work using smart antennas Part 2; Metawave Communications Corp.; Redmond, WA; pp. 1-8.
Frequency Phase Effects of Antennas; pp. 3-4.1-3-4.4.
Ho, et al.; Analysis of Electrically Large Patch Phased Arrays via CFDTD; U.S. Government work pp. 1571-1574.
Osseiran; et al.; A Method for Designing Fixed Multibeam Antenna Arrays in WCDMA Systems; IEEE Antennas and Wireless Propagation Letters, vol. 5, 2006; pp. 41-44.
Osseiran; Advanced Antennas in Wireless Communications; Doctoral Thesis; Royal Institute of Technology; Stockholm, Sweden 2006 pp. 1-223.
Hagerman, et al.; WCDMA 6-sector Deployment—Case Study of a Real Installed UMTS-FDD Network; IEEE 2006, pp. 703-707.
Thornton; A Low Sidelobe Asymmetric Beam Antenna for High Altitude Platform Communications; IEEE Microwve and Wireless Components Letters, vol. 14, No. 2, Feb. 2004; pp. 59-61.
Zetterberg; Performance of Three, Six, Nine and Twelve Sector Sites in CDMA—Based on Measurements; Royal Institute of Technology; Stockholm; IEEE 2004.
Pedersen, et al.; Application and Performance of Downlink Beamforming Techniques in UMTS; IEEE Communications Magazine; Oct. 2003; pp. 134-143.
Martínez-Muñoz; Nortel Networks CDMA Advantages of AABS Smart Antenna Technology for CDG; Presentation Nortel Networks; Oct. 1, 2002.
Feuerstein; Smart Antennas are a practical, economical solution to many challenges faced by wireless operators; Wireless Design & Development.
Ericson, et al; Capacity Study for Fixed Multi Beam Antenna Systems in a Mixed Service WCDMA System; IEEE 2001; pp. A-31-A35.
Kalinichev; Analysis of Beam-Steering and Directive Characteristics of Adaptive Antenna Arrays for Mobile Comunications; IEEE Antennas and Propagation Magazine, vol. 43, No. 3, Jun. 2001; pp. 145-152.
Spotlight 2000 Installation Manual for Motorola HD II Cellular Sites; Document 500-0021-02; Jun. 4, 1999; pp. 1-188.
Navel Air Systems Command; Electronic Warfare and Radar Systems Engineering Handbook; Point Mugu, CA Apr. 1, 1999; pp. 1-299.
Feuerstein; Applications of Smart Antennas in Cellular Networks; IEEE 1999; pp. 1096-1099.
Anderson, et al; Adaptive Antennas for GSM and TDMA Systems; IEEE Personal Communications; Jun. 1999; pp. 74-86.
Cheston, et al; Time-Delay Feed Architectures for Active Scanned Arrays; IEEE 1999; pp. 1620-1623.
Lin, et al; Performance of an Angle-of-Arrival Estimator in the Presence of a Mainbeam Interference Source; Navel Research Laboratory; Washington, DC NRL Report 9345 Aug. 21, 1991; pp. 1-13.
Schuman; Minimizing the Number of Control Elements in Phased Arrays by Subarraying; IEEE 1988; pp. 1094-1097.
Frank; Phased Array Antenna Development; John Hopkins University; Springfield VA; Mar. 1967; pp. 1-166.
Chinese Office Action for related application No. 200980151807.2 dated Oct. 18, 2013.
Chinese Office Action for related application No. 200980151807.2 dated Apr. 2, 2013.
Osseiran et al., "Smart Antennas in a WCDMA Radio Network System: Modeling and Evaluations," IEEE Transaction on Antennas and Propagation, vol. 54, No. 11, Nov. 2006, pp. 3302-3316.
Pedersen et al., "Application and Performance of Downlink Beamforming Techniques in UMTS," IEEE Communications Magazine, Oct. 2003, pp. 134-143.
Osseiran et al., "Impact of Angular Spread on Higher Order Sectorization in WCDMA Systems," 2005 IEEE 16th International Symposium on Personal, Indoor and Mobile Radio Communications, pp. 301-305.
Pattan, Bruno "The Versatile Butler Matrix," Microwave Journal, Nov. 2004.
Fitchard, Kevin "Sculpting Radio Waves," Wireless Review, Apr. 3, 2006.
Yea, Ji-Hae "Smart antennas for Multiple Sectorization in CDMA Cell Sites," RF tx/rx (www.rfdesign.com), Apr. 2001, pp. 28-38.
TenXc Wireless Wideband Bi-Sector Array, Apr. 12, 2007, Model BSA-W65-20F004—Preliminary.
TenXc Wireless 4-Column array, Apr. 14, 2008, http://www.tenxc.com/technology.php.
Notification of the First Office Action regarding related Chinese Patent Application No. 201310716957.1, dated May 11, 2015 (6 pgs.).
Search Report regarding related Chinese Patent Application No. 201310716957.1, dated May 11, 2015 (2 pgs.).
Notification of the First Office Action, State Intellectual Property Office (SIPO) of the People's Republic of China, Chinese Application No. 201310716957.1; Search Report.

* cited by examiner

110

NORMALIZED MAGNITUDE (dB)
0
-5
-10
-15
-20
-25
-30
-80
-40
0
40
80
AZIMUTHAL ANGLE (DEGREE)

120

121
NORMALIZED MAGNITUDE (dB)
0
-4
-8
-12
-16
-20
-24
-28
-90
-60
-30
0
30
60
90
ELEVATION ANGLE (DEGREE)

DUAL-BEAM SECTOR ANTENNA AND ARRAY

CROSS REFERENCE TO RELATED APPLICATIONS

This application is a 35 U.S.C. §371 national stage application of PCT International Application No. PCT/US2009/006061, filed Nov. 12, 2009, which itself claims priority of Provisional Application U.S. Ser. No. 61/199,840 filed on Nov. 19, 2008 entitled Dual-Beam Antenna Array, the teaching of which are incorporated herein. The disclosure and content of both of which are incorporated herein by reference in their entireties. The above-referenced PCT International Application was published in the English language as International Publication No. WO2010/059786 A1 on May 27, 2010.

FIELD OF THE INVENTION

The present invention is generally related to radio communications, and more particularly to multi-beam antennas utilized in cellular communication systems.

BACKGROUND OF THE INVENTION

Cellular communication systems derive their name from the fact that areas of communication coverage are mapped into cells. Each such cell is provided with one or more antennas configured to provide two-way radio/RF communication with mobile subscribers geographically positioned within that given cell. One or more antennas may serve the cell, where multiple antennas commonly utilized and each are configured to serve a sector of the cell. Typically, these plurality of sector antennas are configured on a tower, with the radiation beam(s) being generated by each antenna directed outwardly to serve the respective cell.

In a common 3-sector cellular configuration, each sector antenna usually has a 65° 3 dB azimuth beamwidth (AzBW). In another configuration, 6-sector cells may also be employed to increase system capacity. In such a 6-sector cell configuration, each sector antenna may have a 33° or 45° AzBW as they are the most common for 6-sector applications. However, the use of 6 of these antennas on a tower, where each antenna is typically two times wider than the common 65° AzBW antenna used in 3-sector systems, is not compact, and is more expensive.

Dual-beam antennas (or multi-beam antennas) may be used to reduce the number of antennas on the tower. The key of multi-beam antennas is a beamforming network (BFN). A schematic of a prior art dual-beam antenna is shown in FIG. 1A and FIG. 1B. Antenna 11 employs a 2×2 BFN 10 having a 3 dB 90° hybrid coupler shown at 12 and forms both beams A and B in azimuth plane at signal ports 14. (2×2 BFN means a BFN creating 2 beams by using 2 columns). The two radiator coupling ports 16 are connected to antenna elements also referred to as radiators, and the two ports 14 are coupled to the phase shifting network, which is providing elevation beam tilt (see FIG. 1B). The main drawback of this prior art antenna as shown in FIG. 1C is that more than 50% of the radiated power is wasted and directed outside of the desired 60° sector for a 6-sector application, and the azimuth beams are too wide (150°@−10 dB level), creating interference with other sectors, as shown in FIG. 1D. Moreover, the low gain, and the large backlobe (about −11 dB), is not acceptable for modern systems due to high interference generated by one antenna into the unintended cells. Another drawback is vertical polarization is used and no polarization diversity.

In other dual-beam prior art solutions, such as shown in U.S. Patent application U.S. 2009/0096702 A1, there is shown a 3 column array, but which array also still generates very high sidelobes, about −9 dB.

Therefore, there is a need for an improved dual-beam antenna with improved azimuth sidelobe suppression in a wide frequency band of operation, having improved gain, and which generates less interference with other sectors and better coverage of desired sector.

SUMMARY OF INVENTION

The present invention achieves technical advantages by integrating different dual-beam antenna modules into an antenna array. The key of these modules (sub-arrays) is an improved beam forming network (BFN). The modules may advantageously be used as part of an array, or as an independent antenna. A combination of 2×2, 2×3 and 2×4 BFNs in a complete array allows optimizing amplitude and phase distribution for both beams. So, by integrating different types of modules to form a complete array, the present invention provides an improved dual-beam antenna with improved azimuth sidelobe suppression in a wide frequency band of operation, with improved coverage of a desired cellular sector and with less interference being created with other cells. Advantageously, a better cell efficiency is realized with up to 95% of the radiated power being directed in a desired sector. The antenna beams' shape is optimized and adjustable, together with a very low sidelobes/backlobes.

In one aspect of the present invention, an antenna is achieved by utilizing a M×N BFN, such as a 2×3 BFN for a 3 column array and a 2×4 BFN for a 4 column array, where M≠N.

In another aspect of the invention, 2 column, 3 column, and 4 column radiator modules may be created, such as a 2×2, 2×3, and 2×4 modules. Each module can have one or more dual-polarized radiators in a given column. These modules can be used as part of an array, or as an independent antenna.

In another aspect of the invention, a combination of 2×2 and 2×3 radiator modules are used to create a dual-beam antenna with about 35 to 55° AzBW and with low sidelobes/backlobes for both beams.

In another aspect of the invention, a combination of 2×3 and 2×4 radiator modules are integrated to create a dual-beam antenna with about 25 to 45° AzBW with low sidelobes/backlobes for both beams.

In another aspect of the invention, a combination of 2×2, 2×3 and 2×4 radiator modules are utilized to create a dual-beam antenna with about 25 to 45° AzBW with very low sidelobes/backlobes for both beams in azimuth and the elevation plane.

In another aspect of the invention, a combination of 2×2 and 2×4 radiator modules can be utilized to create a dual-beam antenna.

All antenna configurations can operate in receive or transmit mode.

DETAILED DESCRIPTION OF THE PREFERRED EMBODIMENT

Figure 2A:
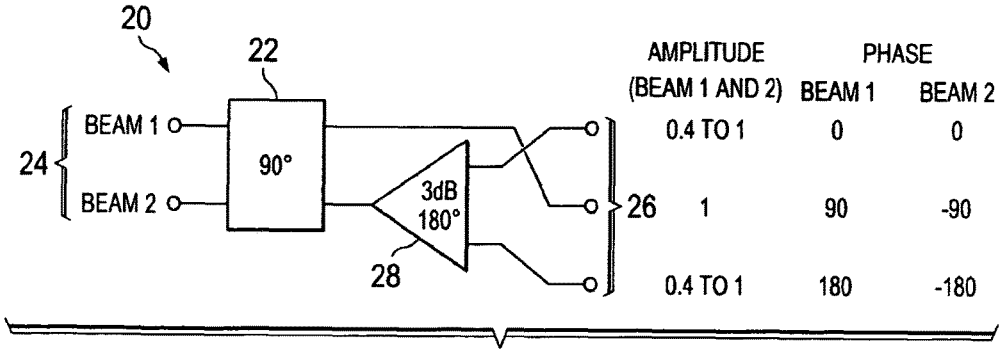
FIG. 2A shows a 2×3 BFN according to one embodiment of the present invention which forms 2 beams with 3 columns of radiators.

Referring now to FIG. 2A, there is shown one preferred embodiment comprising a bidirectional 2×3 BFN at 20 configured to form 2 beams with 3 columns of radiators, where the two beams are formed at signal ports 24. A 90° hybrid coupler 22 is provided, and may or may not be a 3 dB coupler. Advantageously, by variation of the splitting coefficient of the 90° hybrid coupler 22, different amplitude distributions of the beams can be obtained for radiator coupling ports 26: from uniform (1-1-1) to heavy tapered (0.4-1-0.4). With equal splitting (3 dB coupler) 0.7-1-0.7 amplitudes are provided. So, the 2×3 BFN 20 offers a degree of design flexibility, allowing the creation of different beam shapes and sidelobe levels. The 90° hybrid coupler 22 may be a branch line coupler, Lange coupler, or coupled line coupler. The wide band solution for a 180° equal splitter 28 can be a Wilkinson divider with a 180° Shiffman phase shifter. However, other dividers can be used if desired, such as a rat-race 180° coupler or 90° hybrids with additional phase shift. In FIG. 2A, the amplitude and phase distribution on radiator coupling ports 26 for both beams Beam 1 and Beam 2 are shown to the right. Each of the 3 radiator coupling ports 26 can be connected to one radiator or to a column of radiators, as dipoles, slots, patches etc. Radiators in column can be a vertical line or slightly offset (staggered column).

Figure 2B:
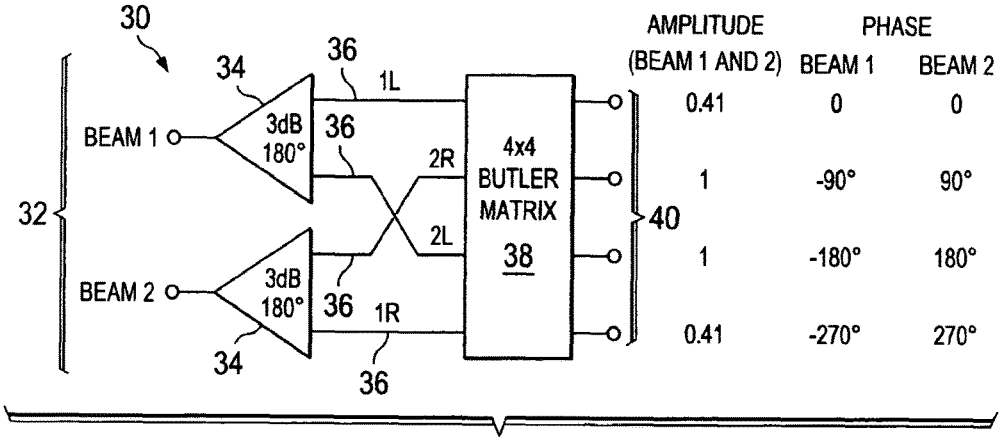
FIG. 2B is a schematic diagram of a 2×4 BFN, which forms 2 beams with 4 columns of radiators, including the associated phase and amplitude distribution for both beams.

FIG. 2B is a schematic diagram of a bidirectional 2×4 BFN 30 according to another preferred embodiment of the present invention, which is configured to form 2 beams with 4 columns of radiators and using a standard Butler matrix 38 as one of the components. The 180° equal splitter 34 is the same as the splitter 28 described above. The phase and amplitudes for both beams Beam 1 and Beam 2 are shown in the right hand portion of the figure. Each of 4 radiator coupling ports 40 can be connected to one radiator or to column of radiators, as dipoles, slots, patches etc. Radiators in column can stay in vertical line or to be slightly offset (staggered column).

Figure 2C:
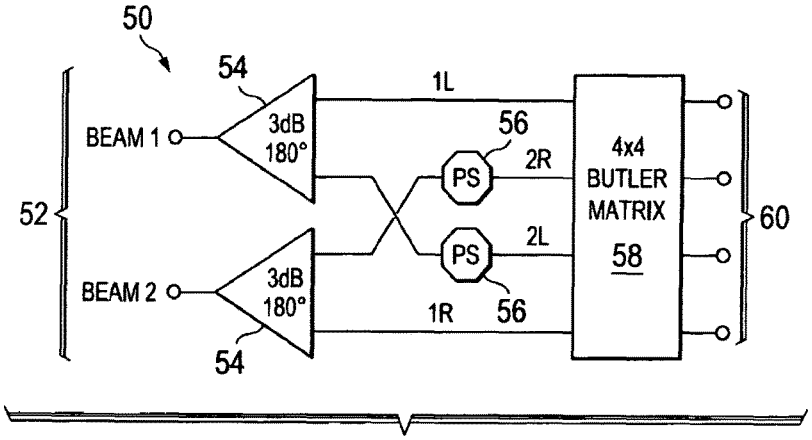
FIG. 2C is a schematic diagram of a 2×4 BFN, which forms 2 beams with 4 columns of radiators, and further provided with phase shifters allowing slightly different AzBW between beams and configured for use in cell sector optimization.

FIG. 2C is a schematic diagram of another embodiment comprising a bidirectional 2×4 BFN at 50, which is configured to form 2 beams with 4 columns of radiators. BFN 50 is a modified version of the 2×4 BFN 30 shown in FIG. 2B, and includes two phase shifters 56 feeding a standard 4×4 Butler Matrix 58. By changing the phase of the phase shifters 56, a slightly different AzBW between beams can be selected (together with adjustable beam position) for cell sector optimization. One or both phase shifters 56 may be utilized as desired.

The improved BFNs 20, 30, 50 can be used separately (BFN 20 for a 3 column 2-beam antenna and BFN 30, 50 for 4 column 2-beam antennas). But the most beneficial way to employ them is the modular approach, i.e. combinations of the BFN modules with different number of columns/different BFNs in the same antenna array, as will be described below.

Figure 1A:
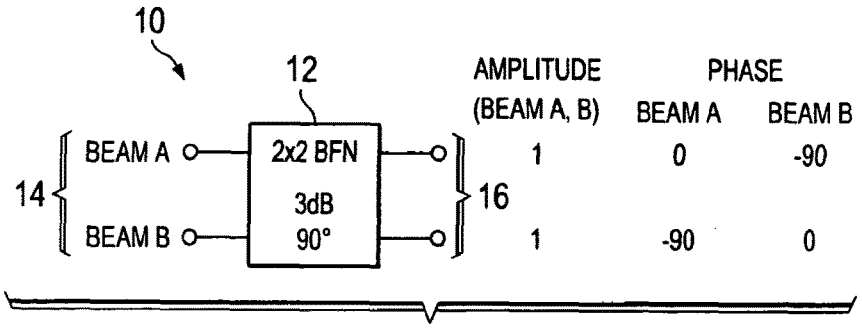
FIG. 1A (PRIOR ART)
FIGS. 1A, 1B, 1C and 1D shows a conventional dual-beam antenna with a conventional 2×2 BFN.
Figure 1B:
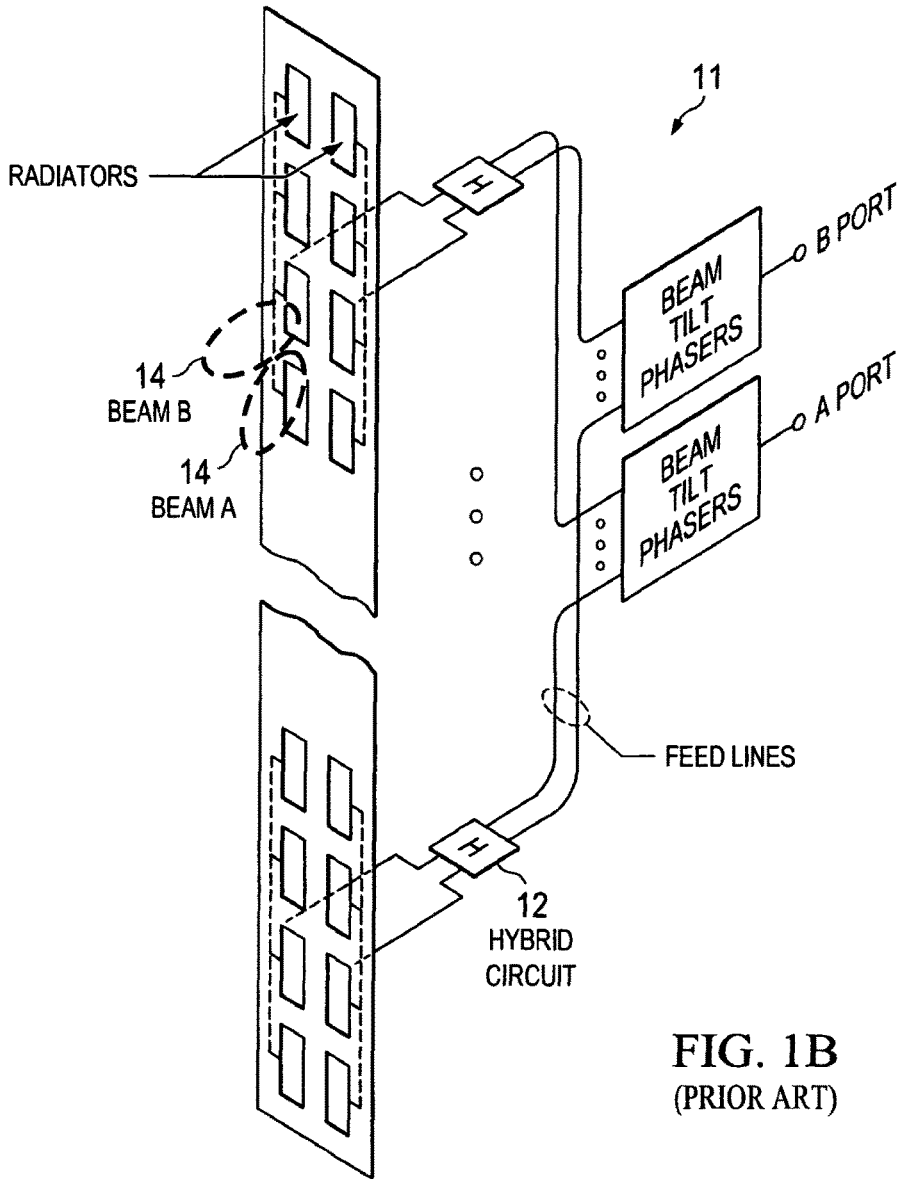
FIG. 1B (PRIOR ART)
Figure 1C:
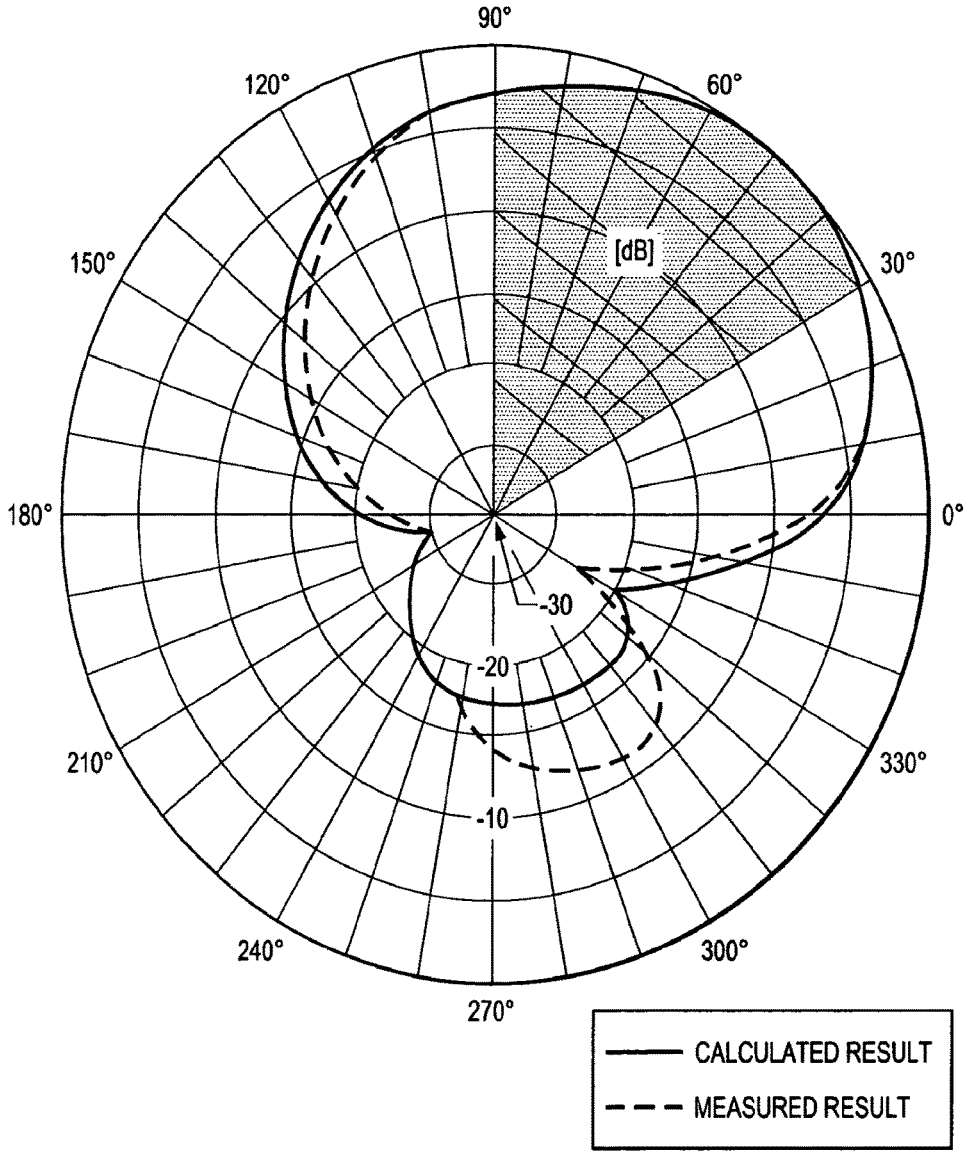
FIG. 1C (PRIOR ART)
Figure 1D:
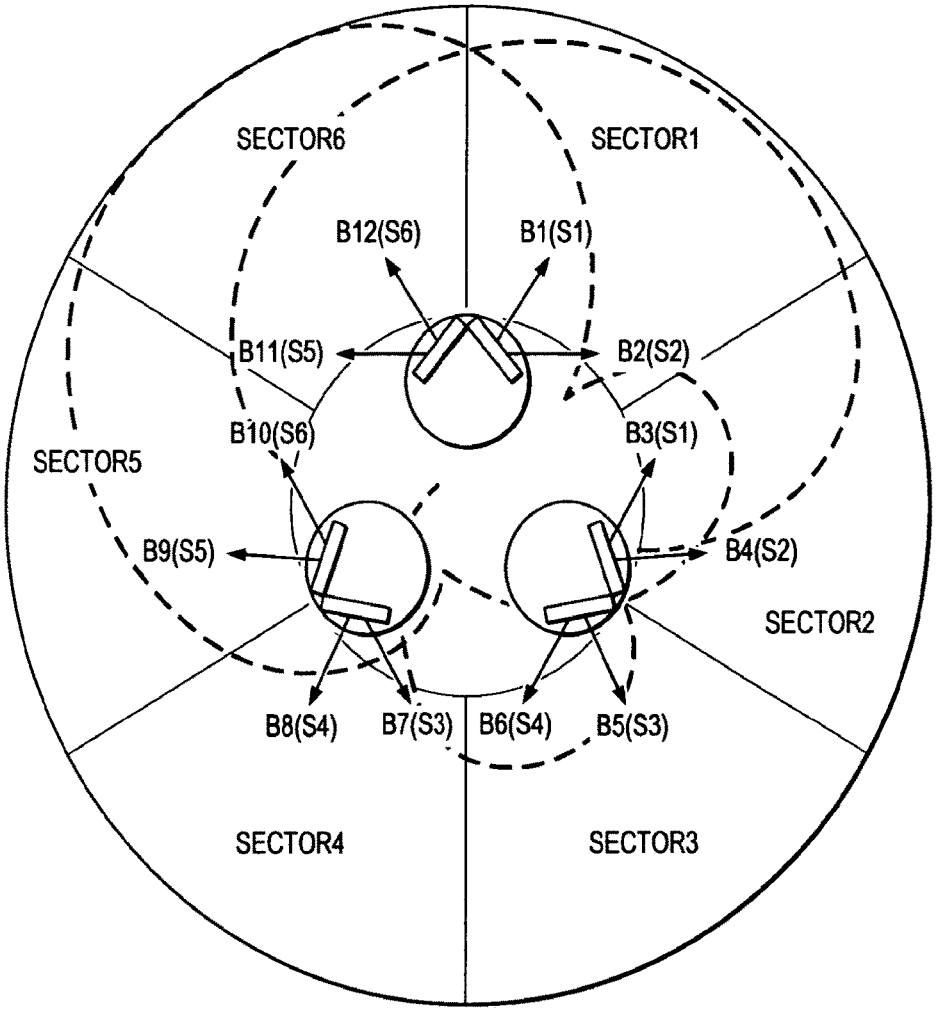
FIG. 1D (PRIOR ART)
Figure 3:
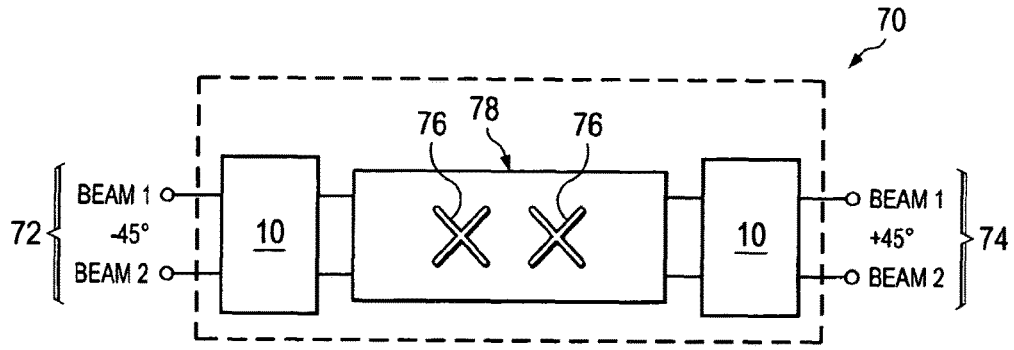
FIG. 3 illustrates how the BFNs of FIG. 1A can be advantageously combined in a dual polarized 2 column antenna module.

FIG. 3 shows a dual-polarized 2 column antenna module with 2×2 BFN's generally shown at 70. 2×2 BFN 10 is the same as shown in FIG. 1A. This 2×2 antenna module 70 includes a first 2×2 BFN 10 forming beams with −45° polarization, and a second 2×2 BFN 10 forming beams with +45° polarization, as shown. Each column of radiators 76 has at least one dual polarized radiator, for example, a crossed dipole.

Figure 4:
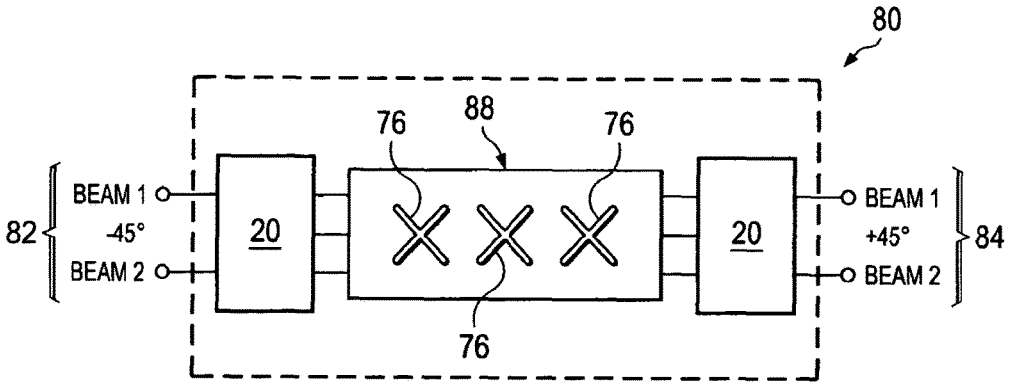
FIG. 4 shows how the BFN of FIG. 2A can be combined in a dual polarized 3 column antenna module.

FIG. 4 shows a dual-polarized 3 column antenna module with 2×3 BFN's generally shown at 80. 2×3 BFN 20 is the same as shown in FIG. 2A. This 2×3 antenna module 80 includes a first 2×3 BFN 20 forming beams with −45° polarization, and a second 2×3 BFN 20 forming beams with +45° polarization, as shown. Each column of radiators 76 has at least one dual polarized radiator, for example, a crossed dipole.

Figure 5:
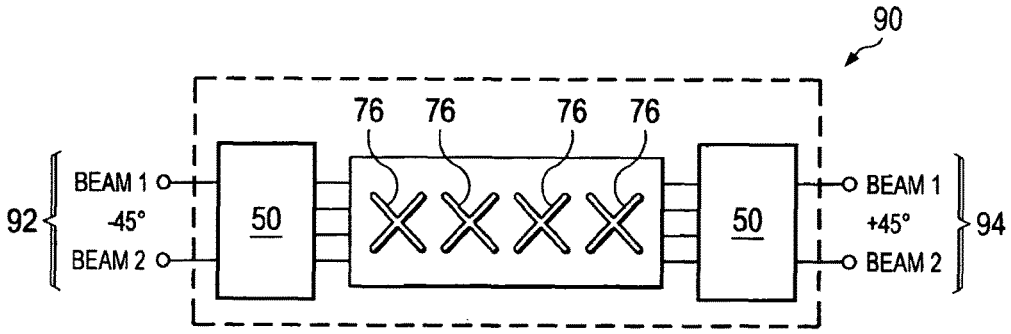
FIG. 5 shows how the BFNs of FIG. 2B or FIG. 2C can be combined in dual polarized 4 column antenna module.

FIG. 5 shows a dual-polarized 4 column antenna module with 2×4 BFN's generally shown at 90. 2×4 BFN 50 is the same as shown in FIG. 2C. This 2×4 antenna module 80 includes a first 2×4 BFN 50 forming beams with −45° polarization, and a second 2×4 BFN 50 forming beams with +45° polarization, as shown. Each column of radiators 76 has at least one dual polarized radiator, for example, a crossed dipole.

Below, in FIGS. 6-10, the new modular method of dual-beam forming will be illustrated for antennas with 45 and 33 deg., as the most desirable for 5-sector and 6-sector applications.

Figure 6:
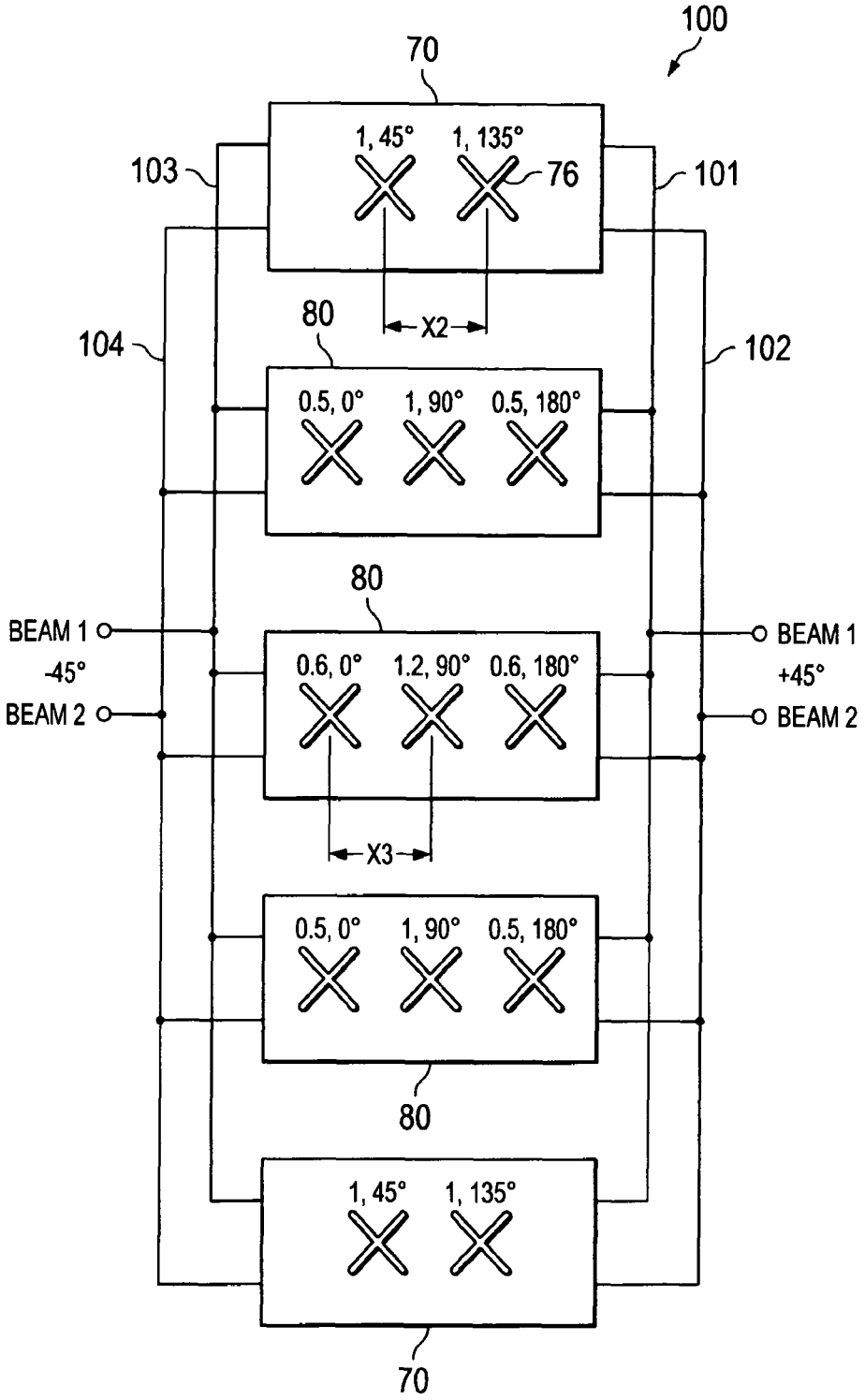
FIG. 6 shows one preferred antenna configuration employing the modular approach for 2 beams each having a 45° AzBW, as well as the amplitude and phase distribution for the beams as shown near the radiators.

Referring now to FIG. 6, there is generally shown at 100 a dual polarized antenna array for two beams each with a 45° AzBW. The respective amplitudes and phase for one of the beams is shown near the respective radiators 76. The antenna configuration 100 is seen to have 3 2×3 modules 80 is and two 2×2 modules 70. Modules are connected with four vertical dividers 101, 102, 103, 104, having 4 ports which are related to 2 beams with +45° polarization and 2 beams with −45° polarization), as shown in FIG. 6. The horizontal spacing between radiators columns 76 in module 80 is X3, and the horizontal spacing between radiators in module 70 is X2. Preferably, dimension X3 is less than dimension X2, X3<X2. However, in some applications, dimension X3 may equal dimension X2, X3=X2, or even X3>X2, depending on the desired radiation pattern. Usually the spacings X2 and X3 are close to half wavelength (λ/2), and adjustment of the spacings provides adjustment of the resulting AzBW. The splitting coefficient of coupler 22 was selected at 3.5 dB to get low Az sidelobes and high beam cross-over level of 3.5 dB.

Figure 7A:
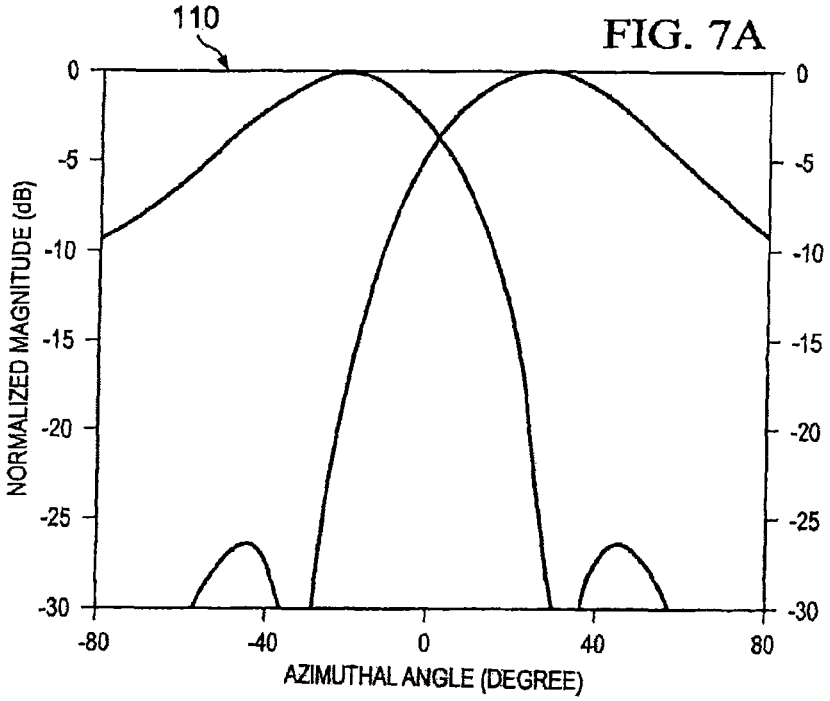
FIG. 7A and FIG. 7B show the synthesized beam pattern in azimuth and elevation planes utilizing the antenna configuration shown in FIG. 6.
Figure 7B:
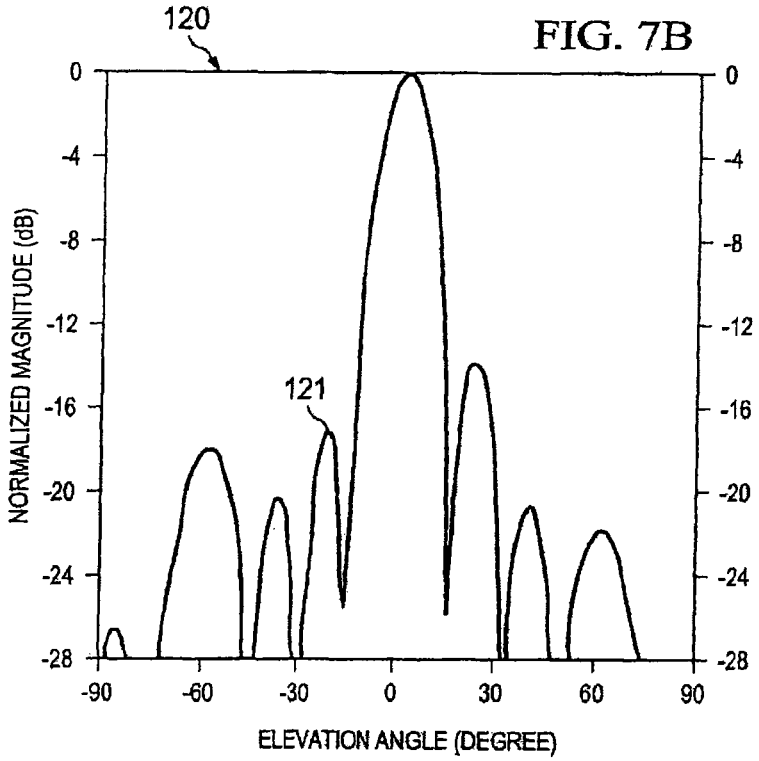

Referring to FIG. 7A, there is shown at 110 a simulated azimuth patterns for both of the beams provided by the antenna 100 shown in FIG. 6, with X3=X2=0.46λ and 2 crossed dipoles in each column 76, separated by 0.87λ As shown, each azimuth pattern has an associated sidelobe that is at least −27 dB below the associated main beam with beam cross-over level of −3.5 dB. Advantageously, the present invention is configured to provide a radiation pattern with low sidelobes in both planes. As shown in FIG. 7B, the low level of upper sidelobes 121 is achieved also in the elevation plane (<−17 dB, which exceeds the industry standard of <−15 dB). As it can be seen in FIG. 6, the amplitude distribution and the low sidelobes in both planes are achieved with small amplitude taper loss of 0.37 dB. So, by selection of a number of 2×2 and 2×3 modules, distance X2 and X3 together with the splitting coefficient of coupler 22, a desirable AzBW together with desirable level of sidelobes is achieved. Vertical dividers 101,102,103,104 can be combined with phase shifters for elevation beam tilting.

Figure 8A:
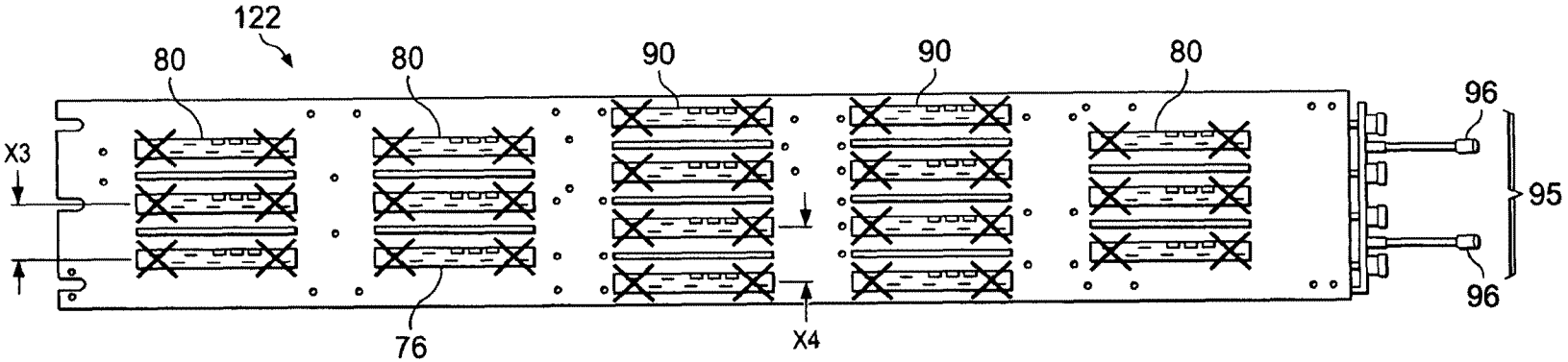
FIGS. 8A and 8B depicts a practical dual-beam antenna configuration when using 2×3 and 2×4 modules.

FIG. 8A depicts a practical dual-beam antenna configuration for a 33° AzBW, when viewed from the radiation side of the antenna array, which has three (3) 3-column radiator modules 80 and two (2) 4-column modules 90. Each column 76 has 2 crossed dipoles. Four ports 95 are associated with 2 beams with +45 degree polarization and 2 beams with −45 degree polarization.

Figure 8B:
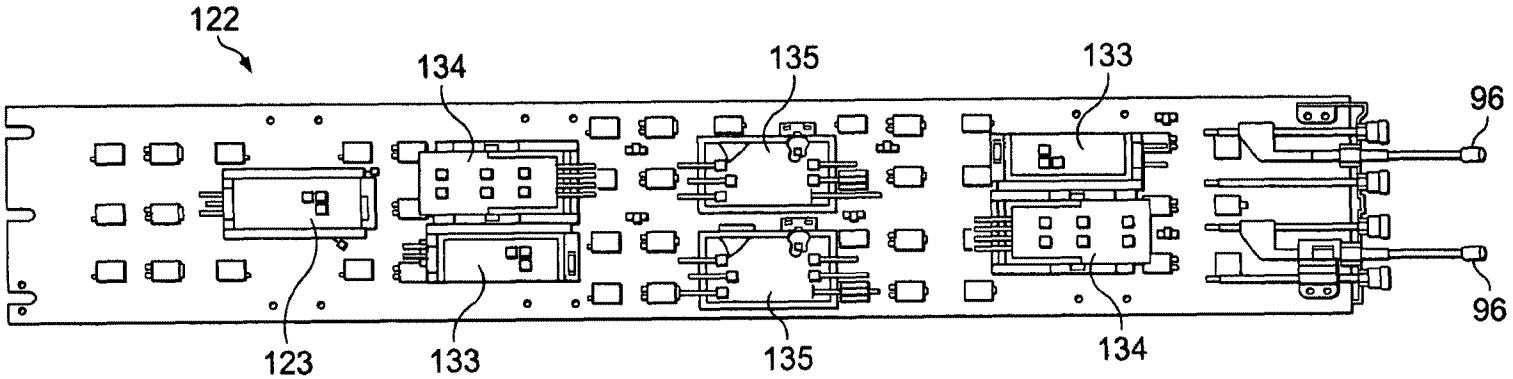

FIG. 8B shows antenna 122 when viewing the antenna from the back side, where 2×3 BFN 133 and 2×4 BFN 134 are located together with associated phase shifters/dividers 135. Phase shifters/dividers 135, mechanically controlled by rods 96, provide antenna 130 with independently selectable down tilt for both beams.

Figure 9:
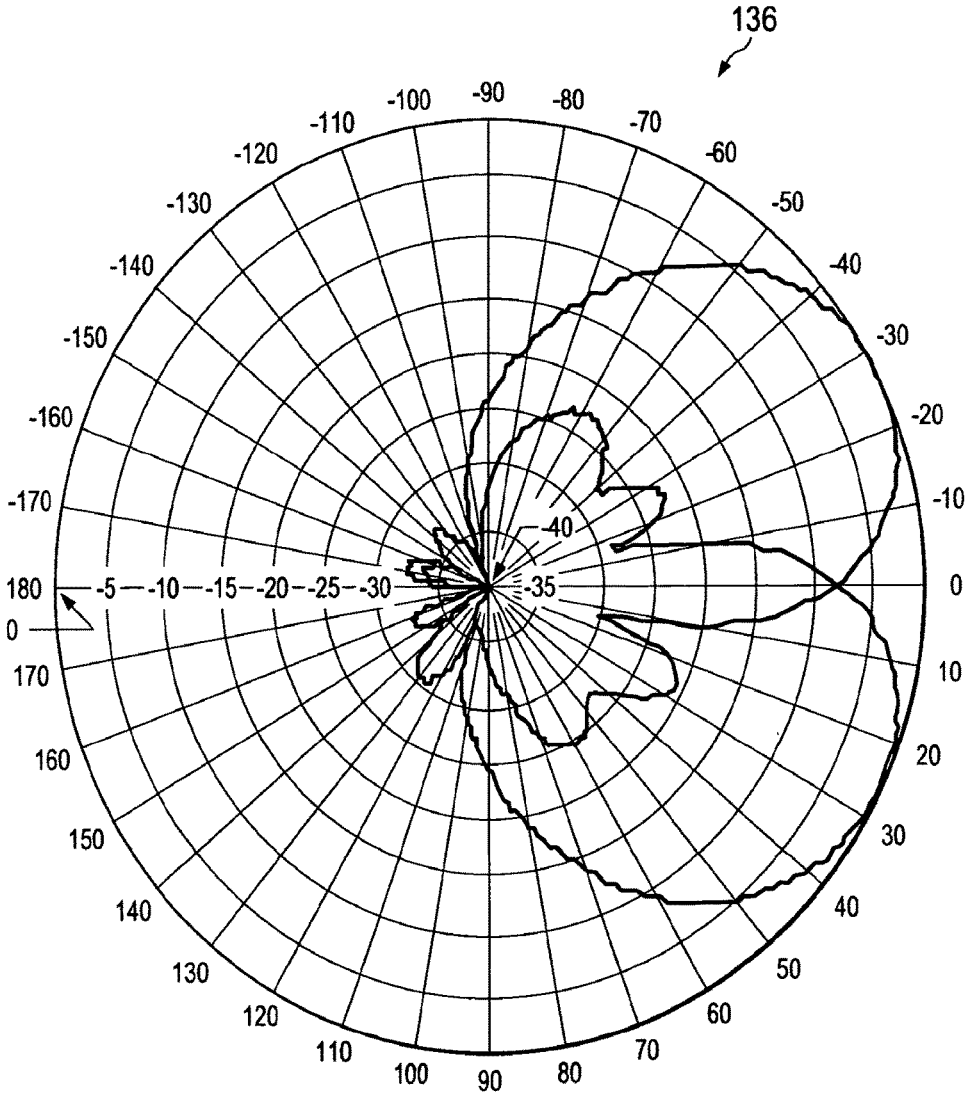
FIGS. 9-10 show the measured radiation patterns with low sidelobes for the configuration shown in FIG. 8A and FIG. 8B.

FIG. 9 is a graph depicting the azimuth dual-beam patterns for the antenna array 122 shown in FIG. 8A, 8B, measured at 1950 MHz and having 33 deg. AzBW.

Figure 10:
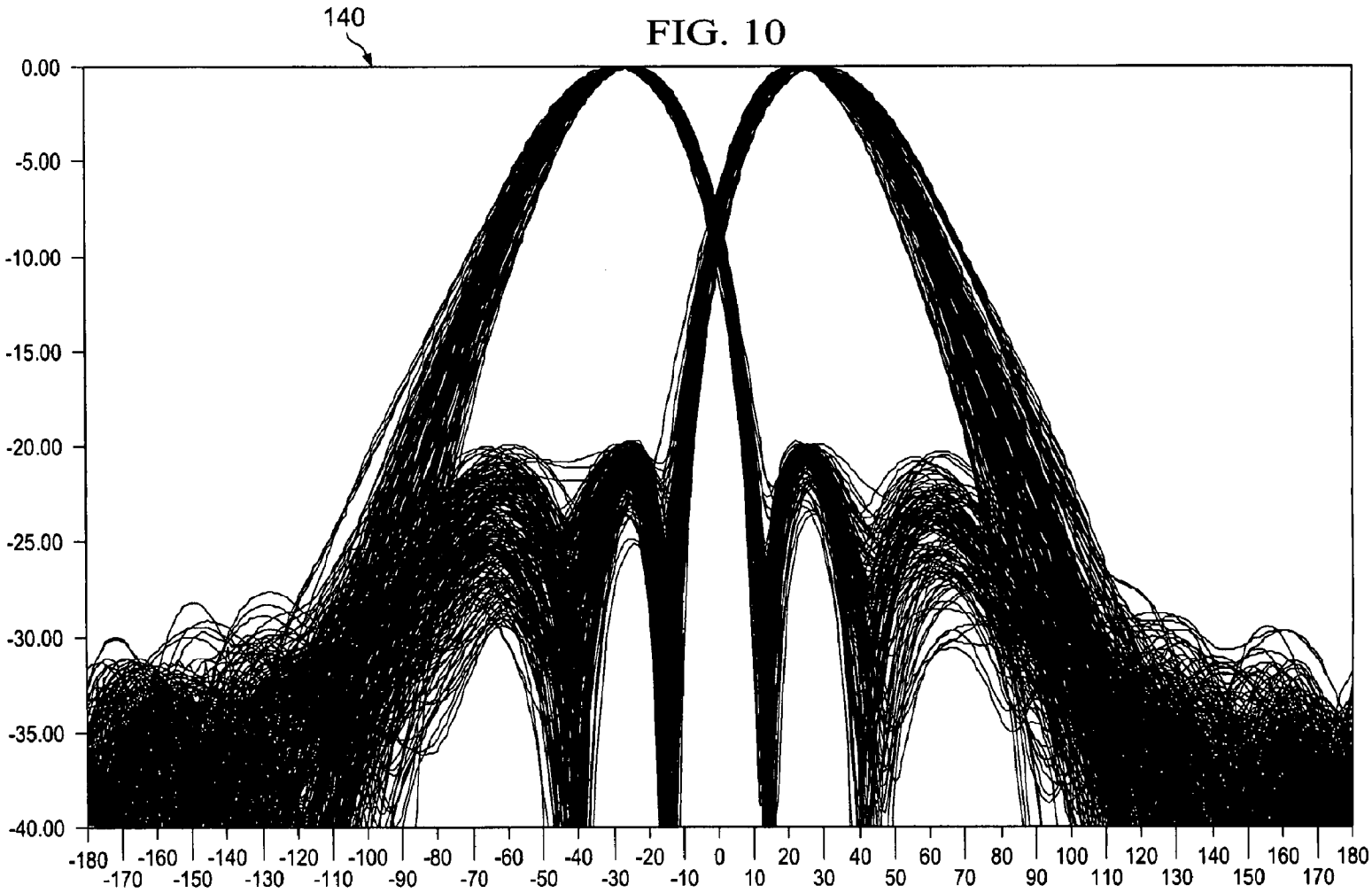

Referring to FIG. 10, there is shown at 140 the dual beam azimuth patterns for the antenna array 122 of FIG. 8A, 8B, measured in the frequency band 1700-2200 MHZ. As one can see from FIGS. 9 and 10, low side lobe level (<20 dB) is achieved in very wide (25%) frequency band. The Elevation pattern has low sidelobes, too (<−18 dB).

As can be appreciated in FIGS. 9 and 10, up to about 95% of the radiated power for each main beam, Beam 1 and Beam 2, is directed in the desired sector, with only about 5% of the radiated energy being lost in the sidelobes and main beam portions outside the sector, which significantly reduces interference when utilized in a sectored wireless cell. Moreover, the overall physical dimensions of the antenna 122 are significantly reduced from the conventional 6-sector antennas, allowing for a more compact design, and allowing these sector antennas 122 to be conveniently mounted on antenna towers. Three (3) of the antennas 122 (instead of six antennas in a conventional design) may be conveniently configured on an antenna tower to serve the complete cell, with very little interference between cells, and with the majority of the radiated power being directed into the intended sectors of the cell.

For instance, the physical dimensions of 2-beam antenna 122 in FIG. 8A, 8B are 1.3×0.3 m, the same as dimensions of conventional single beam antenna with 33 deg. AzBW.

In other designs based on the modular approach of the present invention, other dual-beam antennas having a different AzBW may be achieved, such as a 25, 35, 45 or 55 degree AzBW, which can be required for different applications. For example, 55 and 45 degree antennas can be used for 4 and 5 sector cellular systems. In each of these configurations, by the combination of the 2×2, 2×3 and 2×4 modules, and the associated spacing X2, X3 and X4 between the radiator columns (as shown in FIGS. 6 and 8A), the desired AzBW can be achieved with very low sidelobes and also adjustable beam tilt. Also, the splitting coefficient of coupler 22 provides another degree of freedom for pattern optimization. In the result, the present invention allows to reduce azimuth sidelobes by 10-15 dB in comparison with prior art.

Though the invention has been described with respect to a specific preferred embodiment, many variations and modifications will become apparent to those skilled in the art upon reading the present application. For example, the invention can be applicable for radar multi-beam antennas. The intention is therefore that the appended claims be interpreted as broadly as possible in view of the prior art to include all such variations and modifications.

What is claimed is:

1. A multi-beam cellular communication antenna, comprising:

an antenna array having a plurality of rows of radiating elements, wherein a first of the rows includes at least two radiating elements and a second of the rows includes at least three radiating elements and has a different number of radiating elements than the first of the rows; and an antenna feed network that is configured to couple at least a first input signal and a second input signal to all of the radiating elements of the antenna array.

2. The multi-beam cellular communication antenna of claim 1, wherein the antenna array is configured to generate a first beam that points in a first direction responsive to the first input signal and to generate a second beam that points in a second direction responsive to the second input signal.

3. The multi-beam cellular communication antenna of claim 2, wherein the first beam covers a first sector of a cell of a wireless communication system and the second beam covers a second sector of the cell.

4. The multi-beam cellular communication antenna of claim 2, wherein the first of the rows includes a total of three radiating elements and the second of the rows includes a total of four radiating elements.

5. The multi-beam cellular communication antenna of claim 4, wherein a third of the rows includes a total of four radiating elements and a fourth of the rows includes a total of three radiating elements.

6. The multi-beam cellular communication antenna of claim 5, wherein the second and third of the rows are between the first and fourth of the rows.

7. The multi-beam cellular communication antenna of claim 5, wherein ones of the radiating elements in the first of the rows are aligned in a column direction that is perpendicular to a row direction with respective ones of the radiating elements in the fourth of the rows and ones of the radiating elements in the second of the rows are aligned in the column direction with respective ones of the radiating elements in the third of the rows.

8. The multi-beam cellular communication antenna of claim 4, wherein the antenna feed network comprises a 2×3 beamforming network that couples the first and second input signals to the first of the rows, a 2×4 beamforming network that couples the first and second input signals to the second of the rows, a first power divider that couples the first input signal to the 2×3 beamforming network and to the 2×4 beamforming network, and a second power divider that couples the second input signal to the 2×3 beamforming network and to the 2×4 beamforming network.

9. The multi-beam cellular communication antenna of claim 8, wherein the 2×3 beamforming network comprises a 90° hybrid coupler and a 180° splitter.

10. The multi-beam cellular communication antenna of claim 8, wherein the 2×4 beamforming network comprises a pair of 180° 3 dB splitters and a 4×4 Butler matrix.

11. The multi-beam cellular communication antenna of claim 10, wherein the 2×4 beamforming network further comprises at least one phase shifter interposed between each of the 180° 3 dB splitters and the 4×4 Butler matrix.

12. The multi-beam cellular communication antenna of claim 1, wherein a first distance between two adjacent radiating elements in the first of the rows is greater than a second distance between two adjacent radiating elements in the second of the rows.

13. A multi-beam cellular communication antenna, comprising:

a plurality of first subarrays that are spaced apart from each other along a column direction, each of the first subarrays comprising M radiating elements that are spaced apart from each other along a row direction that is perpendicular to the column direction and comprising a 2×M beamforming network that is configured to couple first and second input signals to all of the radiating elements of the respective first subarray;

a plurality of second subarrays that are spaced apart from each other and from the first subarrays along the column direction, each of the second subarrays comprising N radiating elements that are spaced apart from each other along the row direction, N being not equal to M, and comprising a 2×N beamforming network that is configured to couple the first and second input signals to all of the radiating elements of the respective second subarray; and a power distribution network configured to provide both of the first and second input signals to the respective 2×M beamforming network of each of the first subarrays and to the respective 2×N beamforming network of each of the second subarrays.

14. The multi-beam cellular communication antenna of claim 13, wherein the multi-beam cellular communication antenna is configured to generate a first beam that points in a first direction responsive to the first input signal and to generate a second beam that points in a second direction responsive to the second input signal.

15. The multi-beam cellular communication antenna of claim 13, wherein M=3 and N=4.

16. The multi-beam cellular communication antenna of claim 13, wherein the M radiating elements of each of the first subarrays comprise a respective first row of M radiating elements and wherein each of the first subarrays comprise a second row of M radiating elements, and wherein the N radiating elements of each of the second subarrays comprise a respective first row of N radiating elements and wherein each of the second subarrays comprise a second row of N radiating elements.

17. The multi-beam cellular communication antenna of claim 13, wherein the plurality of second subarrays are arranged between two of the plurality of first subarrays in the column direction.

18. A multi-beam cellular communication antenna, comprising:

a first plurality of rows of dual polarized radiating elements, each of the rows in the first plurality of rows including a total of three dual polarized radiating elements that are arranged in a row direction;

a second plurality of rows of dual polarized radiating elements, each of the rows in the second plurality of rows including a total of four dual polarized radiating elements that are arranged in the row direction;

a plurality of first beamforming networks, each of which is configured to provide respective output signals to each of the radiating elements of a respective one of the first plurality of rows, each of the output signals of each of the plurality of first beamforming networks being based on a first input signal and based on a second input signal;

a plurality of second beamforming networks, each of which is configured to provide respective output signals to each of the radiating elements of a respective one of the second plurality of rows, each of the output signals of each of the plurality of second beamforming networks being based on the first input signal and the second input signal;

a plurality of third beamforming networks, each of which is configured to provide respective output signals to each of the radiating elements of a respective one of the first plurality of rows, each of the output signals of each of the plurality of third beamforming networks being based on a third input signal and based on a fourth input signal; and a plurality of fourth beamforming networks, each of which is configured to provide respective output signals to each of the radiating elements of a respective one of the second plurality of rows, each of the output signals of each of the plurality of fourth beamforming networks being based on the third input signal and the fourth input signal, wherein the plurality of first beamforming networks and the plurality of second beamforming networks together form a first beam in a first direction and a second beam in a second direction, and wherein the plurality of third beamforming networks and the plurality of fourth beamforming networks together form a third beam in the first direction and a fourth beam in the second direction.

19. The multi-beam cellular communication antenna of claim 18, wherein the first and second beams are configured to have a polarization that is 90° apart from a polarization of the third and fourth beams.

20. The multi-beam cellular communication antenna of claim 18, wherein the output signals of the first and second beamforming networks are provided to each of radiating elements of a first subarray of radiating elements, the first subarray of radiating elements comprising the first row and comprising a third row of three dual polarized radiating elements arranged in the row direction, the third row being spaced apart from the first row in a column direction that is perpendicular to the row direction, and wherein the output signals of the third and fourth beamforming networks are provided to each of radiating elements of a second subarray of radiating elements, the second subarray of radiating elements comprising the second row and comprising a fourth row of four dual polarized radiating elements arranged in the row direction, the fourth row being spaced apart from the second row in the column direction.

* * * * *